US005984126A

United States Patent [19]

Gordon

[11] Patent Number: 5,984,126

[45] **Date of Patent: *Nov. 16, 1999**

[54] CONTAINER WITH FIRE PROTECTIVE INTUMESCENT LAYER

[75] Inventor: Gerald A. Gordon, Wheeling, Ill.

[73] Assignee: GBC Holding Co., Delaware, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/056,361

[22] Filed: Apr. 7, 1998

[51] Int. Cl.[6] ..... B65D 90/04

[52] U.S. Cl. ..... 220/62.22; 220/88.1; 106/18.11

[58] Field of Search ..... 220/22.1, 62.11, 220/62.15, 62.19, 62.22, 660, 88.1; 106/18.11

[56] References Cited

U.S. PATENT DOCUMENTS

| | | | |
|---|---|---|---|
| 2,106,938 | 2/1938 | Tramm et al. | 134/78.6 |
| 2,628,946 | 2/1953 | Juda et al. | 106/18.15 X |
| 2,650,206 | 8/1953 | Stock | 260/17.4 |
| 2,755,260 | 7/1956 | Stilbert, Jr. et al. . | |
| 3,135,419 | 6/1964 | Bulmer | 220/88.1 X |
| 3,336,153 | 8/1967 | Juda | 220/88.1 X |
| 3,535,130 | 10/1970 | Webb . | |
| 3,669,299 | 6/1972 | Jones et al. . | |
| 3,745,031 | 7/1973 | Kaplan . | |
| 3,992,997 | 11/1976 | McCubbin et al. . | |
| 4,018,983 | 4/1977 | Pedlow | 220/88.1 X |
| 4,144,385 | 3/1979 | Downing et al. . | |
| 4,934,553 | 6/1990 | McCarthy . | |
| 4,989,750 | 2/1991 | McGarvey . | |
| 5,082,138 | 1/1992 | McGarvey . | |
| 5,091,243 | 2/1992 | Tolbert et al. . | |
| 5,092,024 | 3/1992 | McGarvey . | |
| 5,314,027 | 5/1994 | Wood . | |
| 5,367,850 | 11/1994 | Nicholas . | |
| 5,442,884 | 8/1995 | Nicholas . | |
| 5,562,957 | 10/1996 | Hilden | 220/88.1 X |

*Primary Examiner*—Steven Pollard
*Attorney, Agent, or Firm*—Bullwinkel Partners, Ltd.

[57] ABSTRACT

A non-metallic industrial container having a fire resistant outer layer made from a polymer or other thermoplastic resin filled with an intumescent powder and forming part of the structure of the container is provided. The container may be a plastic drum, fibre drum, composite intermediate bulk container or other suitable industrial container. The intumescent layer protects the container from fire by expanding and charring when exposed to intense heat.

6 Claims, 1 Drawing Sheet

FIG. 1
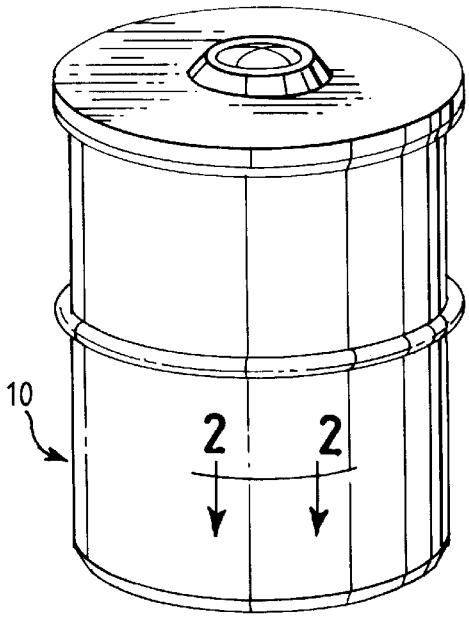
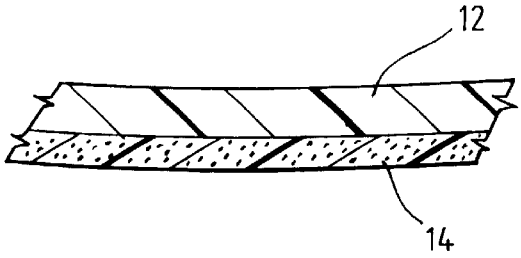
FIG. 2
FIG. 4
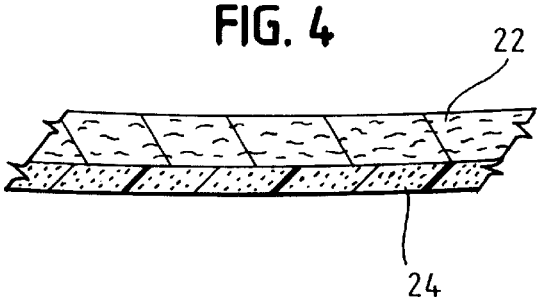
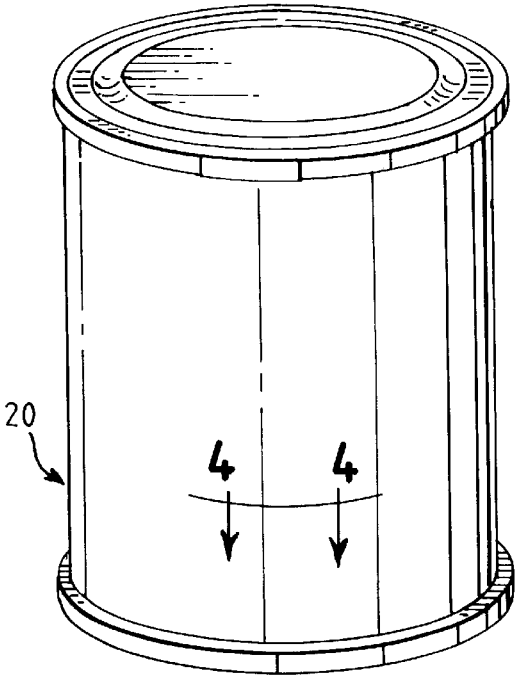
FIG. 3
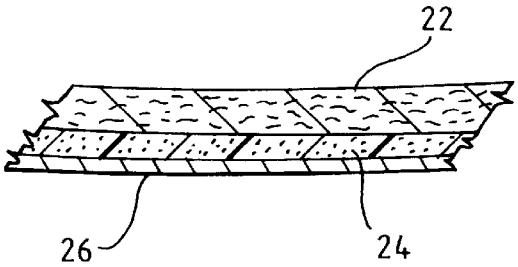
FIG. 5

CONTAINER WITH FIRE PROTECTIVE INTUMESCENT LAYER

BACKGROUND

1. Field of the Invention

This patent relates to fire resistant non-metallic industrial containers. More particularly, this patent relates to industrial containers such as fibre drums, plastic drums and composite intermediate bulk containers having an outer layer of fire resistant intumescent material incorporated into the container structure.

2. Description of the Related Art

Industrial containers made from non-metallic materials of construction (e.g., fibre drums, plastic drums, and composite intermediate bulk containers) may undergo rapid failure under test fire conditions, spilling ladings which, if flammable or combustible, can feed a fire and possibly lead to the more serious loss of the storage facility. For example, in a standard pool fire, a water-filled 55 gallon fibre or plastic drum will fail (spill its contents) in about 3–4 minutes, and a composite IBC (e.g., a 275 gallon capacity polyethylene bottle inside a steel rod cage) will fail in about 90 seconds. If an adequate water sprinkler system is provided, these containers can last indefinitely in such a fire without discharging their contents. The challenge is to provide an industrial container that will survive until the sprinkler system is activated.

Extension of container survival time can provide a sufficient margin of safety such that the containers would be approved under existing fire codes for storage of flammable and/or combustible liquids in protected warehouses (i.e., warehouses whose fire suppression systems and stacking patterns meet the requirements of Section 4.8 of NFPA-30, the Flammable and Combustible Liquids Fire Code).

It has been found that adding an outer layer of intumescent material to non-metallic containers is useful in preventing the rapid failure of such containers in a warehouse fire. The intumescent material swells or expands when heated to form a layer of non-combustible material, sometimes called char, between the combustible non-metallic container surface and the air.

The active ingredient in many intumescent paints is polyammonium phosphate, which emits a gas at elevated temperatures but at lower-than charring temperatures. When the paint is first exposed to elevated temperatures, the gas swells the paint. Upon further heating, the foamed paint chars, forming a low density but coherent ash which insulates the substrate from further heat.

It is known in the art that intumescent coatings may be used as fireproofing agents to protect combustible surfaces. However, not until now has it been suggested that an intumescent layer be added to the outside of an extruded plastic container or a fibre drum for the purpose of providing a container that could be approved under existing fire codes for storage of flammable and/or combustible liquids in protected warehouses.

Thus it is an object of the present invention to provide a non-metallic container that will survive in a fire for a sufficient period of time to allow a sprinkler system to be activated and/or to allow time for fire-fighting personnel to arrive and begin to fight the fire.

A further object of the present invention is to provide a fire protected non-metallic container in which the fire protective feature is incorporated into the structure of the container.

A still further object of the present invention is to provide a fire protected plastic or fibre drum in which a fire protective intumescent layer forms part of the container structure.

Further and additional objects will appear from the description, accompanying drawing, and appended claims.

SUMMARY OF THE INVENTION

The present invention is a non-metallic industrial container having a fire resistant outer layer made from a polymer or thermoplastic resin filled with an intumescent powder and forming part of the structure of the container. The container may be a plastic drum, fibre drum, composite intermediate bulk container or other suitable industrial container.

For containers such as plastic drums and IBCs, the container comprises at least one inner layer of structural material and an outer layer made of a thermoplastic resin filled with an intumescent powder, wherein the drum may be formed by coextrusion of the structural layer and the intumescent layer.

For containers such as fibre drums, the container comprises at least one layer (ply) of fibreboard for structural support and an intumescent layer comprising a polymer filled with intumescent powder. The intumescent layer may be formed by extrusion coating a polymer filled with intumescent powder onto a web of fibreboard, cutting the coated web into sheets, and applying the cut sheets onto the outside of the fibreboard layer. Alternatively, the intumescent layer may be formed by extruding a polymer filled with intumescent powder to form a film and laminating the film onto the outermost fibreboard layer. The fibre drum may further comprise a printed ply wherein the intumescent layer is interposed between the printed ply and the outermost fibreboard layer.

The invention also is a method for making a fire resistant container such as a plastic drum or IBC wherein the method comprises the steps of feeding a structural material into an extruder; separately feeding a thermoplastic resin filled with intumescent powder into an extruder; coextruding a structural material/thermoplastic resin laminate to form a multilayer extruded tube parison; and molding the parison leaving the extruder into a fire resistant container having a layer of structural material and a layer of thermoplastic resin filled with intumescent powder.

DRAWINGS

FIG. 1 is a perspective view of a plastic drum according to the present invention.

FIG. 2 is a cross-sectional view taken along line 2—2 of FIG. 1.

FIG. 3 is a perspective view of a fibre drum according to the present invention.

FIG. 4 is a cross-sectional view taken along line 4—4 of FIG. 3.

FIG. 5 is a cross-sectional view of a fibre drum showing an optional printed ply layer on the outside of the drum.

DEFINITIONS

In the description that follows, a number of terms are used. In order to provide a clear and consistent understanding of the specification and claims, including the scope to be given such terms, the following definitions are provided:

Coextrusion. The technique of forming a two layer article by extruding two layers of thermoplastic materials and combining them into a film sheet or molded unit.

Composite intermediate bulk container. An intermediate bulk container comprising a rigid outer packaging enclosing a plastic inner receptacle together with any service or other structural equipment. The outer packaging is designed to bear the entire stacking load. The inner receptacle and outer packaging form an integral packaging and are filled, stored, transported, and emptied as a unit.

Extruder. A machine for conveying a melted polymer at high temperature and pressure through a specially shaped die.

Extrusion coating. The process of forcing an extruded thermoplastic onto a substrate.

Fibre drum. A drum made from a material such as heavy paperboard, formed into a multi-ply tube by convolute winding on a mandrel. Top and bottom headings may be formed from fibreboard, plastic, metal or other suitable material and are attached to the ends of the tube.

Intermediate bulk container (IBC). Industrial containers having a capacity of 450 to 3,000 liters (about 119 to 793 gallons), used to transport and store bulk liquids.

Intumescence. The property of a material to swell or expand when heated, usually due to gas formation.

Lading. Container contents.

Lamination. The process of adhering one thin layer to another layer, typically but not necessarily with adhesives.

Polymer. Chemical compound or mixture of compounds formed by polymerization and consisting essentially of repeating structural links.

Thermoplastic Resin. A polymeric resin having the property of being rigid at room temperature but losing rigidity when heated.

Web. A continuous sheet of paper, foil, plastic film or other flexible material used in a manufacturing process.

DETAILED DESCRIPTION OF THE INVENTION

The present invention is an improved non-metallic industrial container, such as a plastic drum, IBC, or fibre drum, wherein the improvement is the addition of an outer layer formed of polyethylene or other thermoplastic resin filled with an intumescent powder filler. The intumescent powder filler layer protects the container from fire by expanding and charring when exposed to intense heat. The char provides thermal insulation to the container, extending the container survival time to allow a sprinkler system to be activated and/or to allow time for fire-fighting personnel to arrive and begin to fight the fire.

A significant aspect of the present invention is that the intumescent layer forms an integral part of the structure of the solid container. That is, the present invention is a solid container having a separate layer of intumescent material affixed to a structural layer, either by coextrusion, lamination, or other suitable means.

For the manufacture of fire-resistant plastic drums such as depicted in FIG. 1, or IBCs (not pictured), the structural layer and intumescent layer may be coextruded using conventional coextrusion blowmolding equipment. One or more extruders plasticating different resin streams may be used to produce a multi-layer parison, which is then blow molded to form the drum or IBC bottle with the intumescent layer on the outside.

FIG. 2 is a cross-sectional view of the fire-resistant plastic drum 10 depicted in FIG. 1. The plastic drum 10 comprises a structural layer 12 and a fire protective intumescent layer 14. Preferably the fire protective intumescent layer 14 is on the outside of the container 10, away from the liquid contents. The intumescent layer 14 may comprise a polyethylene matrix with embedded intumescent powder filler or other suitable material. The two layers may be affixed by any suitable means, such as coextrusion. An optional scuff resistant layer (not shown) may be affixed to the outside of the intumescent layer 14.

For the manufacture of fire resistant fibre drums such as that depicted in FIG. 3, or other fibre containers, a polymer filled with intumescent powder may be extrusion coated onto a web of fibreboard which can then be cut into sheets and used as the outside ply, or skin, of a multi-ply fibre drum or other container. In the case of a fibre drum, the coated sheets are applied to the outside of a fibreboard tube. This may be done either before the fibreboard tube has been shaped into a cylinder on a mandrel, while the fibreboard is still on the mandrel, or even after the fibreboard tube has been removed from the mandrel.

Alternatively, the intumescent layer can be coated or painted onto the fibreboard. In either case, the final product comprises one or more fibreboard structural layers and an outside intumescent layer.

FIG. 4 is a cross-sectional view of the fibre drum 20 of FIG. 3 showing a structural layer 22 and an intumescent layer 24. Preferably the intumescent layer is on the outside of the fibre drum 20.

FIG. 5 is a cross-sectional view of a fibre drum having an optional printed ply 26 affixed to the outside of the drum such that the intumescent layer 24 is interposed between the structural layer 22 and the printed ply 26.

Whether the intumescent layer 24 is extruded onto a fibreboard web and then layered onto the fibre drum 20 or painted onto the outside of the fibre drum 20, the intumescent layer 24 performs the same function: to provide a layer that foams and chars when exposed to intense heat, producing an adherent insulative shield to prevent the interior fibre layers of the drum from undergoing combustion, and thus preventing breaching of the drum and subsequent spilling of the liquid lading.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A fire resistant container comprising an inner layer of structural material and an outer layer of thermoplastic resin filled with an intumescent powder, wherein the container is formed by coextrusion of the inner layer and the outer layer, the outer layer and the inner layer being integrally combined into a unitary structure to form a solid container wall.

2. The container of claim 1 wherein the container is a plastic drum.

3. The container of claim 1 wherein the container is an intermediate bulk container.

4. A method for making the fire resistant container of claim 1 comprising the steps of:

(a) feeding the structural material into an extruder;

(b) separately feeding thermoplastic resin filled with intumescent powder into another extruder;

(c) coextruding a structural material/thermoplastic resin filled with intumescent powder laminate to form a multi-layer extruded tube parison; and (d) molding the parison leaving the extruder into a fire resistant container having a layer of structural material and a layer of thermoplastic resin filled with intumescent powder.

5. The method of claim 4 wherein the structural material is a thermoplastic resin.

6. The method of claim 4 wherein the molding step comprises blow molding the parison to form the container.

* * * * *